United States Patent [19]

Miyatake et al.

[11] Patent Number: 4,673,841

[45] Date of Patent: Jun. 16, 1987

[54] LIQUID-COOLED PROJECTION TUBE APPARATUS

[75] Inventors: Yoshito Miyatake, Hirakata; Yasuhiko Wagamitsu, Neyagawa, both of Japan

[73] Assignee: Matsushita Electric Industrial Co., Ltd., Kadoma, Japan

[21] Appl. No.: 691,704

[22] Filed: Jan. 15, 1985

[30] Foreign Application Priority Data

Jan. 18, 1984 [JP] Japan ..... 59-6535
Sep. 11, 1984 [JP] Japan ..... 59-189910

[51] Int. Cl.[4] ..... H01J 29/86; H01J 5/20

[52] U.S. Cl. ..... 313/35; 313/44; 313/45; 313/477 R

[58] Field of Search ..... 313/477 R, 478, 482, 313/35, 44, 45; 358/231, 237, 250; 220/2.1 A

[56] References Cited

U.S. PATENT DOCUMENTS

Re. 25,791 6/1965 Claypoole ..... 220/2.1 A
4,511,927 4/1985 Bauer ..... 358/250
4,529,905 7/1985 Ohkoshi et al. ..... 313/477 X

*Primary Examiner*—Palmer C. DeMeo
*Assistant Examiner*—Sandra L. O'Shea
*Attorney, Agent, or Firm*—Wenderoth, Lind & Ponack

[57] ABSTRACT

A liquid-cooled projection tube apparatus has a projection tube, a metal plate having an opening and fixed in close contact with a face plate of the projection tube, and a transparent plate made of resin fixed in close contact with the metal plate. A space surrounded by the face plate, metal plate and transparent plate is filled with a liquid. The transparent plate has a groove, and the metal plate has a projection around the opening which is fitted into the groove so that the transparent plate is easily positioned with respect to the metal plate and that the liquid is sealed within the space.

14 Claims, 4 Drawing Figures

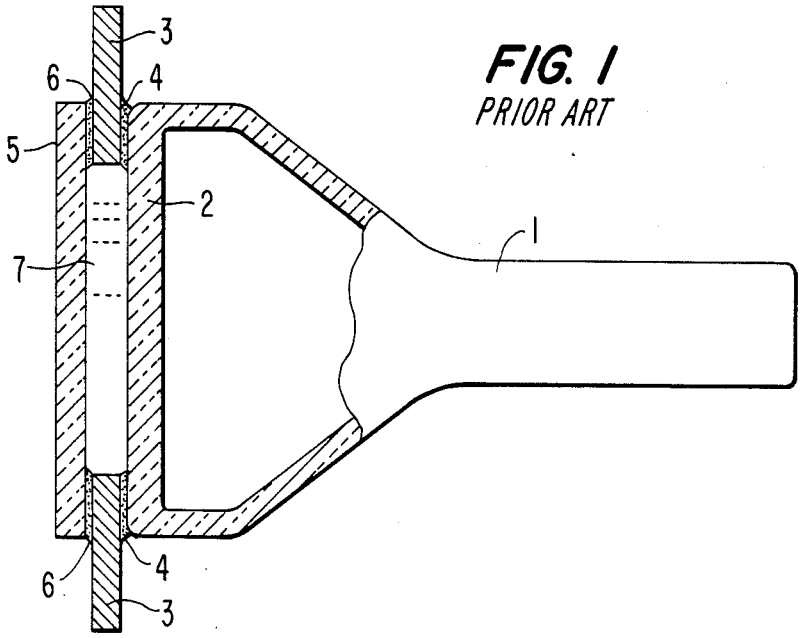
FIG. 1
PRIOR ART
FIG. 2
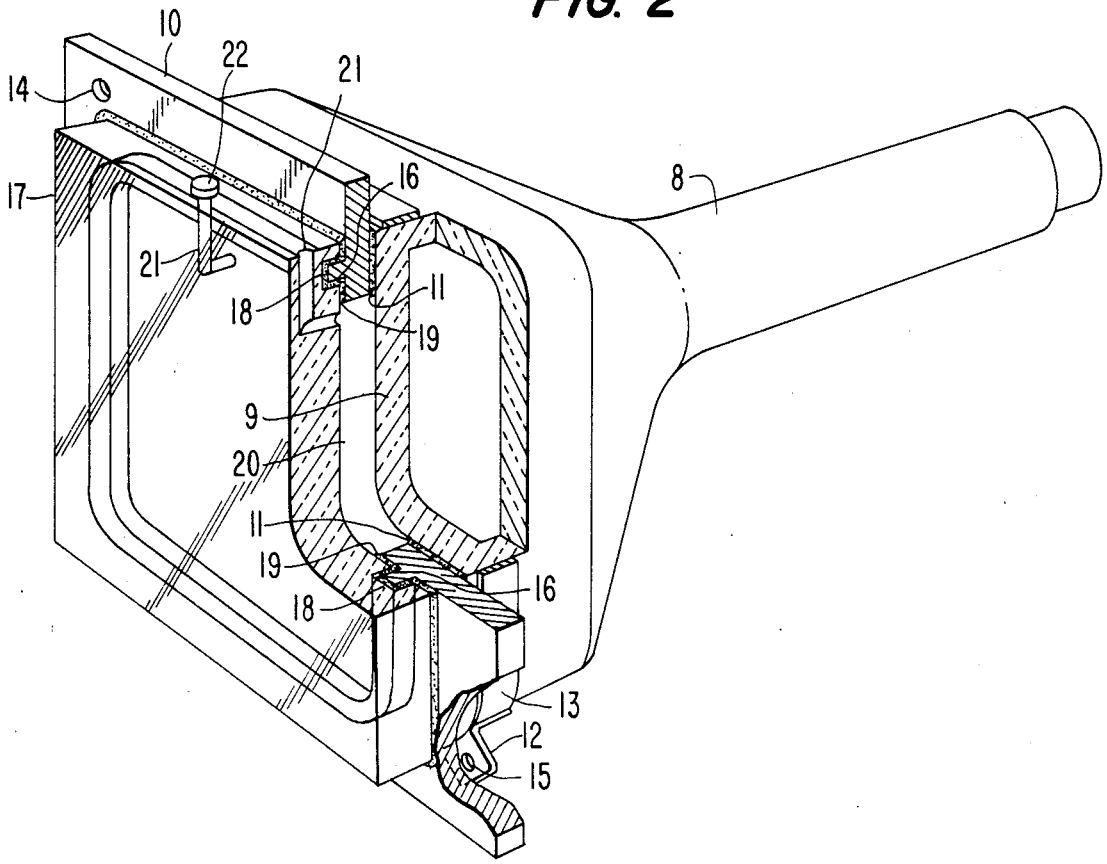

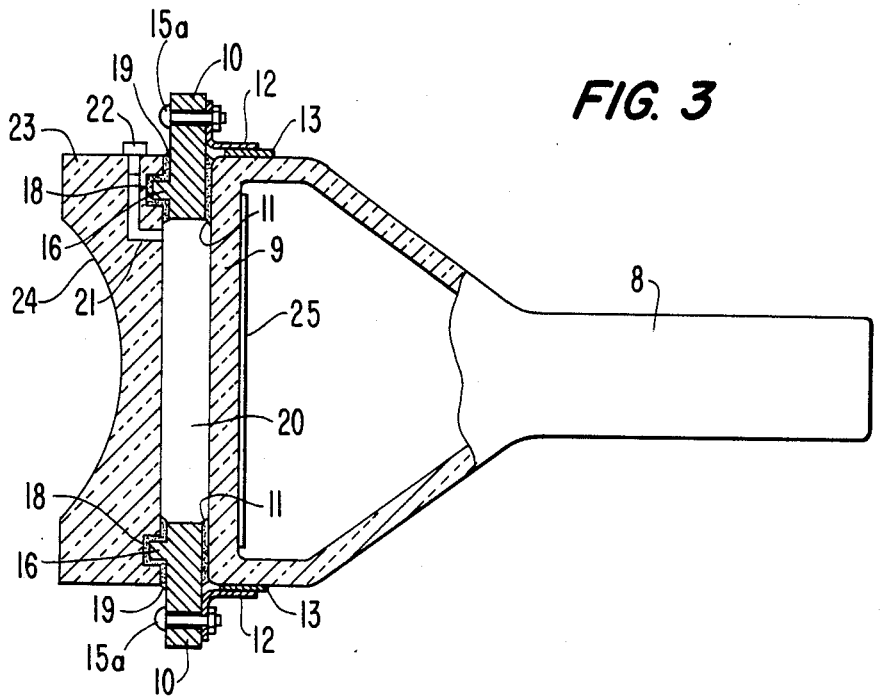
FIG. 3
FIG. 4
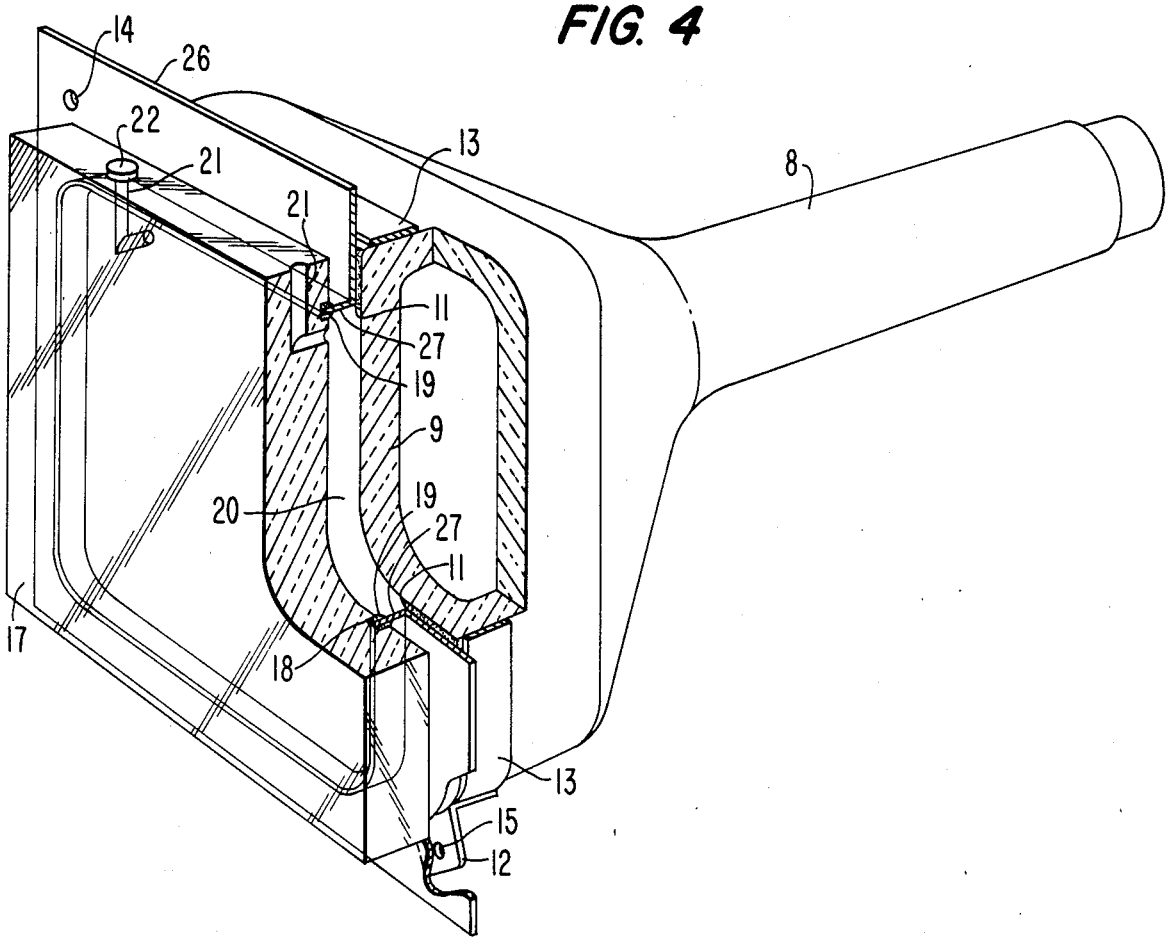

LIQUID-COOLED PROJECTION TUBE APPARATUS

This invention relates to a projection tube used for a television image projection apparatus, and more particularly to a liquid-cooled projection tube which cools a face plate by a liquid to prevent implosion and which emits light with a high brightness.

BACKGROUND OF THE INVENTION AND PRIOR ART

In order to obtain television images on a large screen, one prior art method picks up a television picture on a relatively smaller cathode-ray tube and projects a magnified picture of the television picture on the screen by the use of a projection lens. Since it is desired that the projected picture be as bright as possible, a lens having a large aperture ratio and a highly efficient screen are used, and in addition the input power is increased to cause the projection tube to emit light with a high brightness. However, there is a danger of implosion of the projection tube due to thermal expansion. Hence, a method has been proposed which cools the face plate of the projection tube with a liquid so as to avoid an implosion.

Referring to FIG. 1, an example of a prior art liquid-cooled projection tube is shown, in which a windowed metal plate 3 is fixed by an adhesive 4 to a face plate 2 of a projection tube 1 and a flat glass plate 5 is fixed by an adhesive 6 to the metal plate 3. A liquid 7 fills a sealed space defined in the window, so that heat generated from the face plate 2 is transferred to the metal plate 3 by convection from the liquid 7 and then is dissipated from the surface of the metal plate 3 into the surrounding atmosphere. This construction can reduce the temperature at the face plate 2, thereby preventing implosion of the projection tube. Also, the input power to the tube can be increased by an amount equivalent to the reduced temperature to thereby enable the projection tube 1 to emit light having high brightness. The flat glass plate 5, when made of X ray absorbing glass, can absorb the X rays emitted by the projection tube.

The liquid-cooled projection tube shown in FIG. 1 should not leak the liquid. Therefore, the bonding work must be carried out carefully, and therefore the bonding work takes much time. It is proposed for facilitating the bonding work to mount a holder which is an aluminum die casting on the tube 2 in a manner so as to enclose the flat glass plate 5 and the face plate 2, but this requires complicated parts which results in a high manufacturing cost. In any case, the assembly and parts are expensive.

SUMMARY OF THE INVENTION

This invention has been made in order to solve the above problems. An object of the invention is to provide a liquid-cooled projection tube apparatus which can be produced at lower cost than conventional apparatus and has an improved reliability with respect to liquid leakage.

The liquid-cooled projection tube apparatus of the invention comprises a projection tube, a metal plate having at the center a window aperture the edge of which is bent laterally to form a bent portion, a transparent plate having a groove into which the bent portion is fitted, and a liquid. The bent portion is directed outwardly and the metal plate is fixed to a face plate of the projection tube by use of an adhesive. The groove of the transparent plate is filled with the adhesive and then the bent portion of the metal plate is fitted into the groove. The liquid is filled in a sealed space formed between the face plate and the transparent plate, thereby improving reliability against liquid leakage through the adhesive portions and cooling the face plate by convection of the liquid.

The above and further objects and features of the invention will more fully appear from the following detailed description with reference to the accompanying drawings.

BRIEF DESCRIPTION OF THE DRAWINGS

FIG. 1 is a schematic structural view of a conventional liquid-cooled projection tube apparatus;

FIG. 2 is a partially cutaway perspective structural view of an embodiment of a liquid-cooled projection tube apparatus of the present invention;

FIG. 3 is a schematic partially cross-sectional structural view of a modified embodiment of the invention; and FIG. 4 is a partially cutaway perspective structural view of another modified embodiment of the invention.

DESCRIPTION OF THE PREFERRED EMBODIMENTS

Referring to FIG. 2, a metal plate 10 having a window aperture at the center is fixed by an adhesive 11 to a face plate 9 of a projection tube 8 so that the major part of the face plate is exposed through the aperture, and a metallic band 13 having four mounting members 12 thereon is mounted around the periphery of the tube 8 adjacent the face plate 9. Mounting members 12 each have a hole 15 therein. The metal plate 10 is provided at four corners thereof with bores 14, and bolts **15*a* extend through the bores 14 and bores 15 and are tightened to thereby bring the metal plate 10 into tight engagement with the face plate 9. Hence, there is no fear of liquid leakage past the adhesive 11. Around the window aperture on the metal plate 10 is an annular projection 16. A transparent plate 17 having parallel front and rear surfaces is positioned in opposed relationship to the face plate 9. The transparent plate 17 is provided with an annular groove 18 into which the projection 16 on the metal plate 10 is fitted. The groove 18 is first filled with an adhesive 19, and then the projection 16 is fitted into the groove 18. Since the adhesive 19 contacts a large area with respect to the groove 18 and projection 16, the strength of the adhesive connection between the metal plate 10 and the transparent plate 17 is large, whereby there is little likelihood that liquid will leak through the adhesive 19. Also, since the transparent plate 17 in this construction can be positioned with ease with respect to the metal plate 10**, workability for applying the adhesive is superior.

Thus, a sealed space 20 surrounded by the face plate 9, metal plate 10 and transparent plate 17, is formed. In the transparent plate 17 are provided two orifices 21 communicating with the sealed space 20, and a liquid can be supplied into the sealed space 20 through one of the orifices 21, the other of the orifices 21 being used for an air vent when the liquid is being filled into the space, both orifices 21 being plugged by plugs 22 after completion of the filling.

The construction shown in FIG. 2 allows the heat generated from the face plate 9 to be transferred to the metal plate 10 by convection of the liquid, so that the heat is diffused to the exterior from the surface of the metal plate 10. Hence, the temperature of the face plate 9 can be reduced more than when it is not liquid-cooled. Accordingly, the reliability with respect to implosion of the projection tube 8 is improved. Also, the input power can be increased more to cause the tube to emit light having a greater brightness than the conventional apparatus, resulting in the projected image being brighter than the conventional, is obtained.

Since the transparent plate 17 needs to be provided with the groove 18 and liquid filling and air venting orifices 21, it is preferably formed of resin, such as acrylic resin or polycarbonate, which is easily machinable and has extremely good transparency. The liquid is preferably a liquid such as water, ethylene glycol, and silicon oil, which has a larger thermal conductivity, lower viscosity, and superior transparency, and is high in safety. The metal plate 10 is preferably made of a metal such as aluminum or copper, which has a large thermal conductivity, and is more preferably provided with fins to enlarge the radiating area to thereby increase the cooling effect.

Referring to FIG. 3, a modified embodiment of the invention is shown, in which the transparent plate 17 in FIG. 2 is replaced by a transparent plate 23 of a different shape, i.e. one in which the outer, or front, surface 24 is a lens surface. The surface 24 of the transparent plate 23 facing away from the face plate 9, when concave, serves mainly as a lens for compensating for the curvature of field because the surface 24 is in the vicinity of the fluorescent surface 25 of the cathode-ray tube. Such use of the transparent plate 23 as a lens somewhat facilitates the aberration compensation by the projection lens (not shown) disposed in front of the liquid-cooled projection tube apparatus, thereby improving the performance of projection lens to that extent.

Another modified embodiment of the invention is shown in FIG. 4, in which the metal plate 10 in FIG. 2 is replaced by a relatively thin metal plate 26. The edge of the metal plate 26 around the window aperture is bent laterally at a generally right angle to the plate to form a bent flange portion 27 to be fitted into the groove 18 in the transparent plate 17. This embodiment can be assembled in substantially the same way as described with reference to FIG. 2. Since the adhesive 19 has a larger contact area with respect to the groove 18 and bent flange portion 27 compared with the previous embodiments, the adhesive strength of the joint between the metal plate 26 and the transparent plate 17 is greater and the metal plate 26, even when somewhat warped, can still be used, whereby there is little danger that the liquid will leak past the adhesive 19 portion. In addition, the metal plate 26 can be given a smaller thickness even when the liquid has a large thickness, thereby facilitating the press working of the metal plate 26.

The present invention mainly aims at improving the strength of the adhesive joints by increasing the adhesive area when the metal plates 10 and 26 are fixed in contact with the transparent plates 17 and 23, as shown in FIGS. 2, 3 and 4. The adhesive is filled into the groove 18 to facilitate the adhesive coating, and the projection is fitted into the groove 18 to position the transparent plates 17 and 23 with ease. Accordingly, various other modified embodiments may be used. For example, the metal plate may have a groove therein and the transparent plate can have a projection thereon; a plurality of grooves and projections may be provided; or the liquid inlet 21 may be provided in the metal plate 10.

Although several embodiments have been described, they are merely exemplary of the invention and not to be construed as limiting, the invention being defined solely by the appended claims.

What is claimed is:

1. A liquid cooled projection tube apparatus comprising:

a projection tube having a face plate;

a metal plate having a window aperture therein and fixed in liquid tight contact with the face plate of said projection tube with said face plate exposed through said aperture;

a transparent plate formed of resin and fixed in liquid tight contact with said metal plate, said tranparent plate having a groove therein and said metal plate having a projection around said aperture and fitted into and sealed in said groove; and a liquid filling the space defined by said face plate, said aperture and said transparent plate, whereby said transparent plate can be easily positioned with respect to said metal plate and said liquid is sealed within said space.

2. The liquid-cooled projection tube apparatus according to claim 1, wherein both said groove and said projection are annular.

3. The liquid-cooled projection tube apparatus according to claim 1, wherein said groove and projection are a single groove and a single projection respectively.

4. The liquid-cooled projection tube apparatus according to claim 1, wherein said groove and projection are sealed in contact with each other by an adhesive.

5. The liquid-cooled projection tube apparatus according to claim 4, wherein said projection is fitted into said groove after said groove is filled with an adhesive, whereby said metal plate and transparent plate are fixed to each other.

6. The liquid-cooled projection tube apparatus according to claim 1, wherein said transparent plate is concave at the surface thereof facing away from said face plate.

7. The liquid-cooled projection tube apparatus according to claim 1, wherein said transparent plate is provided with an orifice through which said liquid is filled into said space.

8. A liquid cooled projection tube apparatus comprising:

a projection tube having a face plate;

a metal plate having a window aperture therein and fixed in liquid tight contact with the face plate of said projection tube with said face plate exposed through said aperture;

a transparent plate formed of resin and fixed in liquid tight contact with said metal plate, said transparent plate having a groove therein and said metal plate having a laterally bent flange around the edge of said aperture and fitted into and sealed in said groove; and a liquid filling the space defined by said face plate, said aperture and said transparent plate, whereby said transparent plate can be easily positioned with respect to said metal plate and said liquid is sealed within said space.

9. The liquid-cooled projection tube apparatus according to claim 8, wherein said bent flange of said metal plate and said groove of said transparent plate are both annular.

10. The liquid-cooled projection tube apparatus according to claim 8, wherein said bent flange of said metal plate and said groove of said transparent plate are sealed in contact with each other by an adhesive.

11. The liquid-cooled projection tube apparatus according to claim 10, wherein said bent flange of said metal plate is fitted into said groove after said groove is filled therein with said adhesive, whereby said metal plate and transparent plate are fixed to each other.

12. The liquid-cooled projection tube apparatus according to claim 8, wherein said transparent plate is concave at the surface thereof facing away from said face plate.

13. The liquid-cooled projection tube apparatus according to claim 8, wherein said transparent plate is provided with an orifice through which said liquid is filled into said space.

14. A liquid cooled projection tube apparatus comprising:

a projection tube having a face plate, a plurality of mounting members thereon around the peripheral edge of said face plate;

a metal plate having a window aperture therein and sealed in liquid tight contact with the face plate of said projection tube with said face plate exposed through said aperture, bolt means fixing said metal plate to said mounting members;

a transparent plate formed of resin and fixed in liquid tight contact with said metal plate, said transparent plate having a groove therein and said metal plate having a projection around said aperture and fitted into and sealed in said groove; and a liquid filling the space defined by said face plate, said aperture and said transparent plate, whereby said transparent plate can be easily positioned with respect to said metal plate and said liquid is sealed within said space.

* * * * *